US009228375B1

(12) United States Patent
Arnold

(10) Patent No.: US 9,228,375 B1
(45) Date of Patent: Jan. 5, 2016

(54) LOCK FOR A CHAIN

(71) Applicant: Mandex, Inc., Fairfax, VA (US)

(72) Inventor: Arlen Nathan Arnold, Goose Creek, SC (US)

(73) Assignee: Mandex, Inc., Fairfax, VA (US)

( * ) Notice: Subject to any disclaimer, the term of this patent is extended or adjusted under 35 U.S.C. 154(b) by 0 days.

(21) Appl. No.: 14/527,262

(22) Filed: Oct. 29, 2014

(51) Int. Cl.

| | |
|---|---|
| ***E05B 73/00*** | (2006.01) |
| ***E05B 65/00*** | (2006.01) |
| ***E05B 47/00*** | (2006.01) |
| ***E05B 67/00*** | (2006.01) |

(52) U.S. Cl.
CPC ..... *E05B 65/0021* (2013.01); *E05B 47/00* (2013.01); *E05B 67/003* (2013.01); *E05B 73/0005* (2013.01)

(58) Field of Classification Search
CPC ... E05B 73/0005; E05B 67/003; E05B 73/00; E05B 45/005; Y10T 70/5009; Y10T 70/40; Y10T 70/5164; Y10T 24/3902; Y10T 70/5013; E05C 17/365
USPC ..... 70/14, 18, 19, 30, 49, 58, 59, 60, 62, 70/63, 66
See application file for complete search history.

(56) References Cited

U.S. PATENT DOCUMENTS

| | | | | |
|---|---|---|---|---|
| 1,543,467 | A | 6/1925 | Wrigley | |
| 3,375,557 | A | 4/1968 | Parr | |
| 3,690,130 | A * | 9/1972 | Eutzler | 70/18 |
| 3,720,431 | A | 3/1973 | Oliver et al. | |
| 3,810,359 | A | 5/1974 | Schreyer et al. | |
| 4,398,387 | A | 8/1983 | Bary | |
| 4,474,116 | A * | 10/1984 | Castenada et al. | 109/51 |
| 5,154,072 | A * | 10/1992 | Leyden | 70/18 |
| 5,796,337 | A * | 8/1998 | Wachsman | 340/568.8 |
| 6,260,300 | B1 * | 7/2001 | Klebes et al. | 42/70.11 |
| 2003/0024658 | A1 | 2/2003 | Beaudoin et al. | |
| 2004/0103505 | A1 | 6/2004 | Beaudoin et al. | |
| 2007/0056867 | A1 | 3/2007 | Hsieh | |
| 2010/0098485 | A1 | 4/2010 | Womack | |

FOREIGN PATENT DOCUMENTS

| | | | |
|---|---|---|---|
| CA | 702094 | A | 1/1965 |
| DE | 100 34 950 | A1 | 1/2002 |
| WO | 2014/090703 | A1 | 6/2014 |

* cited by examiner

*Primary Examiner* — Suzanne Barrett
(74) *Attorney, Agent, or Firm* — Thompson Coburn LLP

(57) ABSTRACT

A chain lock has a chain engagement portion including a slot configured to allow a link of the chain to pass therethrough with the chain engagement portion engaging an adjacent link of the chain. The chain lock has a pivoting member with a proximal and distal end. The pivoting member pivots about the proximal end such that the distal end is movable between a first position in which the pivoting member distal end is spaced from the slot in a manner to allow a chain to be received in and removed from the slot and a second position in which the pivoting member distal end extends across the slot to prevent the chain from being received in and removed from the slot. The pivoting member has a pivot axis spaced from and parallel to the chain engagement portion.

21 Claims, 4 Drawing Sheets

LOCK FOR A CHAIN

BACKGROUND AND SUMMARY

The following disclosure relates to a lock for a chain. In particular, the disclosure relates to a lock for a chain fall. More in particular, the disclosure relates to a lock for a chain fall used for an overhead door. More in particular, the disclosure relates to a lock for a chain fall, which may be interfaced with an access system that records when the lock is opened and closed, for instance, when a chain fall used for an overhead door is opened and closed.

DETAILED DESCRIPTION

Figure 6:
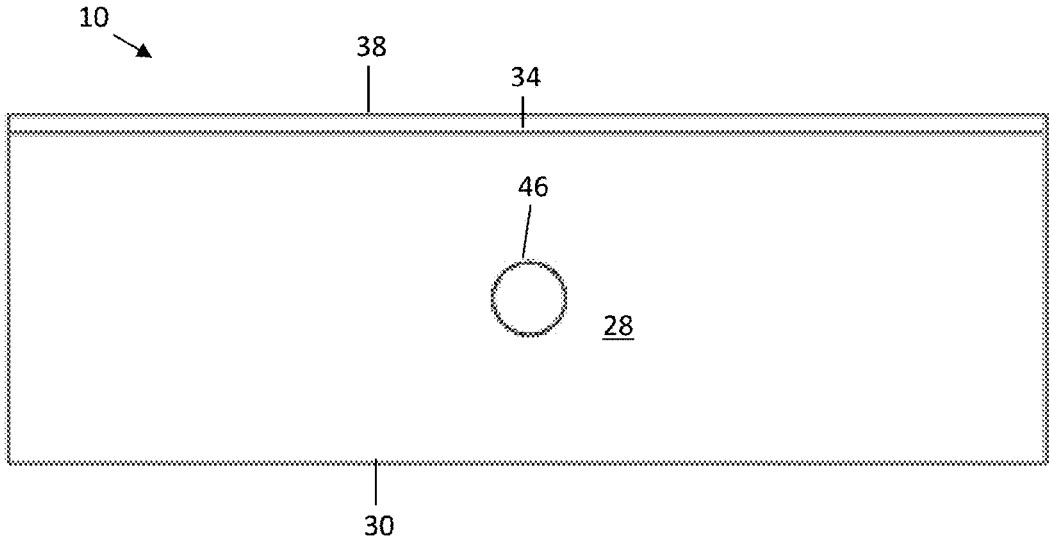
FIG. 6 is a rear view of the lock of FIG. 2.
Figure 7:
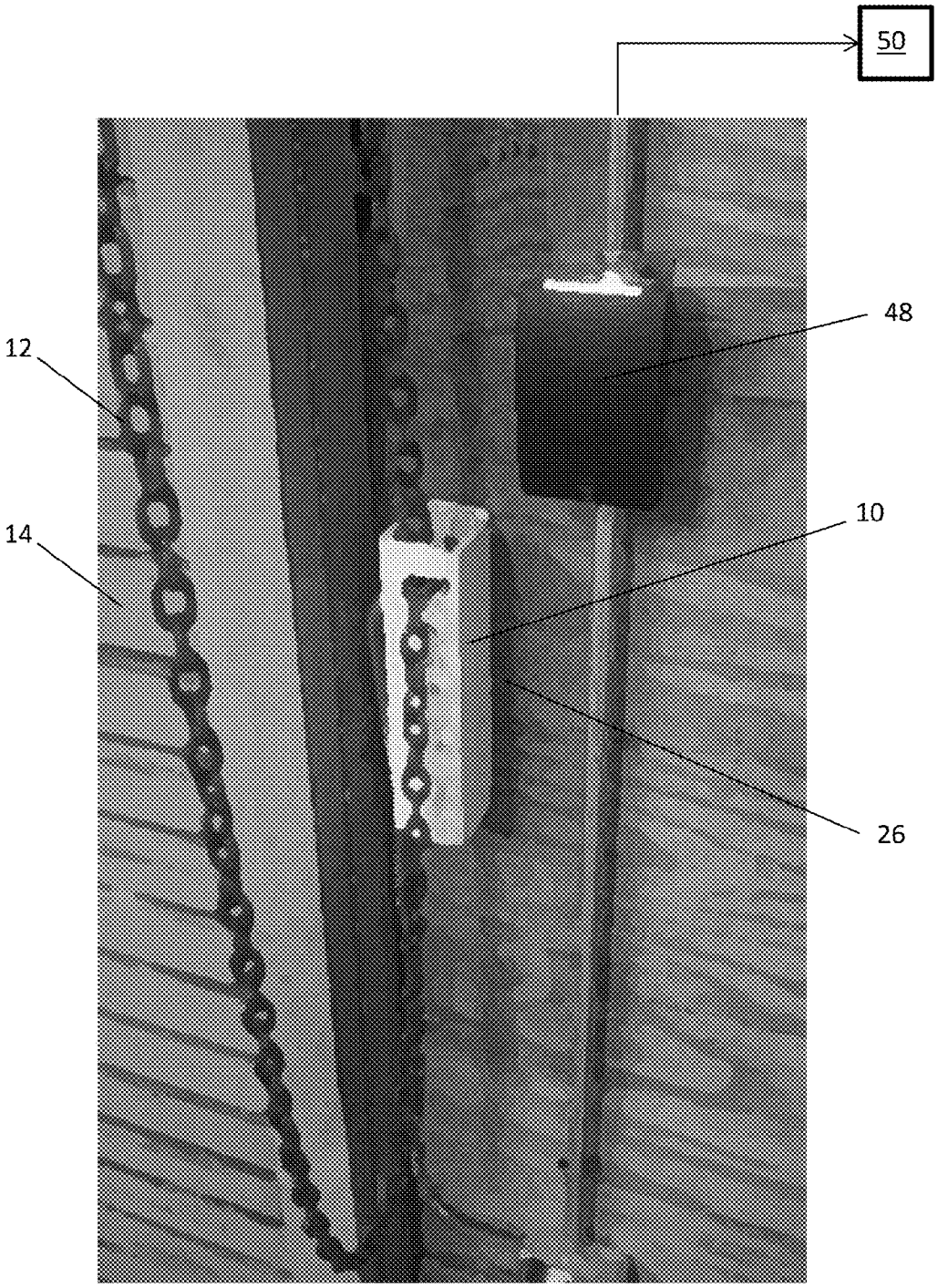
FIG. 7 is a schematic drawing of the lock being used in connection with a chain for a chain falls for an overhead door.

An exemplary lock 10 for a chain is shown in FIGS. 1-7. The lock 10 is configured to be used in connection with a chain comprising a chain falls. In particular, the lock 10 may be used with a chain 12 of a chain fall used for operating an overhead door 14, for instance, as shown in FIG. 7. The lock may also be employed in other environments depending upon the need to lock and unlock a chain.

In one aspect, the lock 10 has a chain engagement portion 16. The chain engagement portion 16 may be a planar member. The chain engagement portion 16 may be a rectangular member. The chain engagement portion 16 may have an edge 18 defining an outer periphery of the chain engagement portion. A slot 20 may extend through the chain engagement portion 16 and communicate with the edge 18 of the chain engagement portion, thus enabling the chain 12 to be received in the slot and removed from the slot at the edge. The slot 20 may extend generally perpendicularly across the chain engagement portion 16 from the edge 18. The slot 20 may extend generally transverse to a length of the chain engagement portion 16, for instance, in a direction generally corresponding to the width of the chain engagement portion. The chain engagement portion 16 may have a second like slot 22 on a longitudinally opposite side of the chain engagement portion. For instance, as shown in the drawing figures, the chain engagement portion 16 comprises a rectangular member and the second slot 22 is provided longitudinally opposite of the first slot 20. The chain engagement portion slot 20,22 may be dimensioned and shaped for a particular dimension chain, for instance, in such a manner as to allow a link of the chain to pass through the slot. The slot 20,22 may be sized and dimensioned to provide a link of a chain with a loose press fit or a slip fit in the slot. The slot 20,22 may be dimensioned to limit movement of the chain relative to the slot and the chain engagement portion 16. The next adjacent link of the chain may be engaged by the chain engagement portion 16. The next adjacent link of the chain may be engaged by either side of the chain engagement portion, for instance, a top surface, or a bottom surface as shown in FIG. 7.

The chain engagement portion 16 may have a base 24 extending therefrom. The base 24 may allow the lock 10 to be mounted to a structure 26 adjacent to the overhead door 14. For instance, as shown in FIG. 7, the lock is mounted on a vertical wall structure 26 adjacent to the overhead door 14. The base 24 may comprise a support member 28 extending from the chain engagement portion 16. The support member 28 may be arranged on an edge opposite the slotted edge 18. The support member 28 may extend perpendicularly from the chain engagement portion 16. The support member 28 may enable the chain engagement portion 16 to be spaced from a structural member 26 (i.e., vertical wall in FIG. 7) where the lock 10 is to be mounted at a convenient distance. The support member 28 may include other mounting surfaces 30 to allow the lock 10 to be mounted to a desired mounting location, for instance, the wall 26 as shown in FIG. 7, or a structure adjacent a wall. For instance, as shown in the drawings, the support member 26 includes a perpendicular mounting portion 30 that allows the lock 10 to be flush mounted to the wall 26. The mounting portion 30 may be parallel to the chain engagement portion 16. By way of example and not in any limiting fashion, in the embodiment of the lock 10 shown in the drawings, the lock comprises a generally U-shaped cross-sectional member with the chain engagement portion 16 spaced from the perpendicular mounting portion 30 by the support member 28. The lock 10 may comprise a channel 32 with the chain engagement portion 16 comprising a side wall spaced apart from another side wall comprising the mounting portion 30 by the support member 28 thereby providing the lock with an overall U-shaped cross-section. The support member and mounting portion may have other configurations relative to the chain engagement portion to give the lock a cross-section resembling, for instance, a "T", "I", "H", "Z" or "L".

The lock 10 may also include a pivoting member 34. The pivoting member 34 may have a proximal end 36 about which the pivoting member pivots. The pivoting member 34 may have a distal end 38 which may move between a first position in which the distal end is spaced from the slot 20,22 in a manner to allow the chain to be received in and removed from the slot. The pivoting member distal end 38 may pivot to a second position in which the pivoting member distal end extends across the slot 20,22 to prevent the chain from being received in and removed from the slot. The pivoting member 34 may have a pivot axis 40 aligned with the proximal edge 36 of the pivoting member. The pivoting axis 40 may be spaced from the chain engagement portion 16. The pivoting axis 40 may also be parallel to the chain engagement portion 16. As shown in the drawing figures, the pivoting axis 40 is spaced from and parallel to the chain engagement portion 16. The pivoting axis 40 may be generally parallel to the edge 18 of the chain engagement portion 16. In the second position, the distal end 38 of the pivoting member 34 may abut the chain engagement portion 16, and may abut the edge 18 across the slot 20,22. In the alternative, in the second position, the distal end 38 of the pivoting member 34 may extend across the slot 20,22 at a slight distance therefrom that is sufficiently small to prevent the chain from being removed from the slot. When the pivoting member 34 moves to the second position, the pivoting member may be generally perpendicular to the chain engagement portion 16. When the pivoting member 34 moves to the second position, the pivoting member may enclose the channel of the U-shaped member. The pivoting member 34 may be a generally rectangular member which is pivotally connected to the mounting portion 30 opposite the support member 28. For instance, as shown in the drawings, the pivoting member proximal end 36 is hingedly connected to the side wall comprising the mounting portion 30 of the U-shaped member opposite the chain engagement portion 16 that forms the other side wall. The pivoting member 34 may pivot via a piano hinge which is disposed within the channel 32 formed by the U-shaped member. The hinge connection may be provided in other locations, for instance, given the arrangement of the support member and mounting portion relative to the chain engagement portion, such that pivoting the pivoting member toward the chain engagement portion enables the pivoting member to be brought against or adjacent to the slot to prevent the chain from being removed therefrom.

With the pivoting member 34 in the second position across the slot 20,22, the chain may be locked in the slot and unable to pass through the slot given the orientation of the next adjacent link of the chain and its engagement with the chain engagement surface 16. The pivoting axis 40 may be aligned vertically (see, e.g., FIG. 7) so that the pivoting member 34 may be moved to the first and second positions without the effect of gravity moving the pivoting member. Thus, when a user wishes to engage the chain 12 in the lock 10, the user may pivot the pivoting member 34 to the first (i.e., open) position to expose the edge 18 of the slot 20,22 of the chain engagement portion 16 and insert the chain link through the slot with the next adjacent link engaging the chain engagement portion. The user may then pivot the pivoting member to the second (i.e., closed) position such that the pivoting member extends across the slot to prevent the chain from being removed from the slot. If the lock 10 has a second slot 22 longitudinally opposite of the first slot 20 of the chain engagement portion 16, the user may likewise insert the chain link through the second slot. By providing a rectangular elongate chain engagement portion 16, the lock 10 may provide an enhanced visual identification when the chain 12 is engaged in the chain lock as the chain is visible against the chain engagement portion. For instance, as shown in FIG. 7, when the chain 12 is engaged in the lock 10, the chain extends across a large portion of the exposed face of the chain engagement portion 16, thereby providing a visual indicator that the chain is engaged in the lock.

Figure 1:
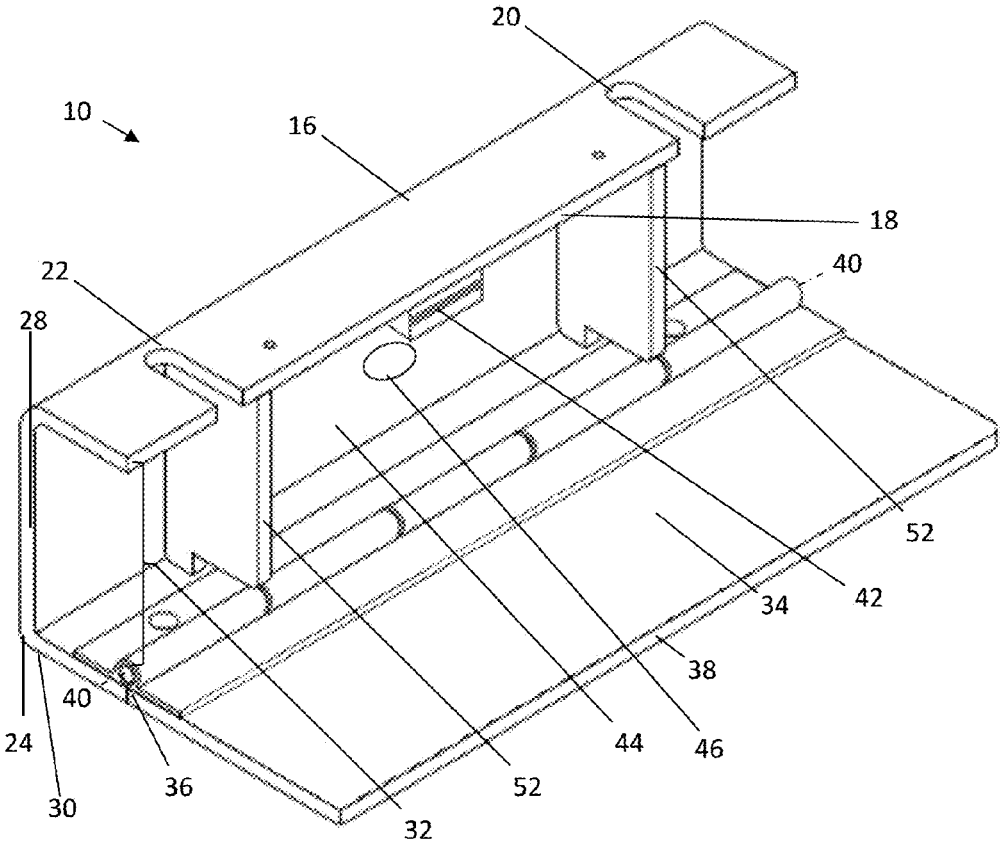
FIG. 1 shows a perspective view of an exemplary embodiment of a lock for a chain.
Figure 2:
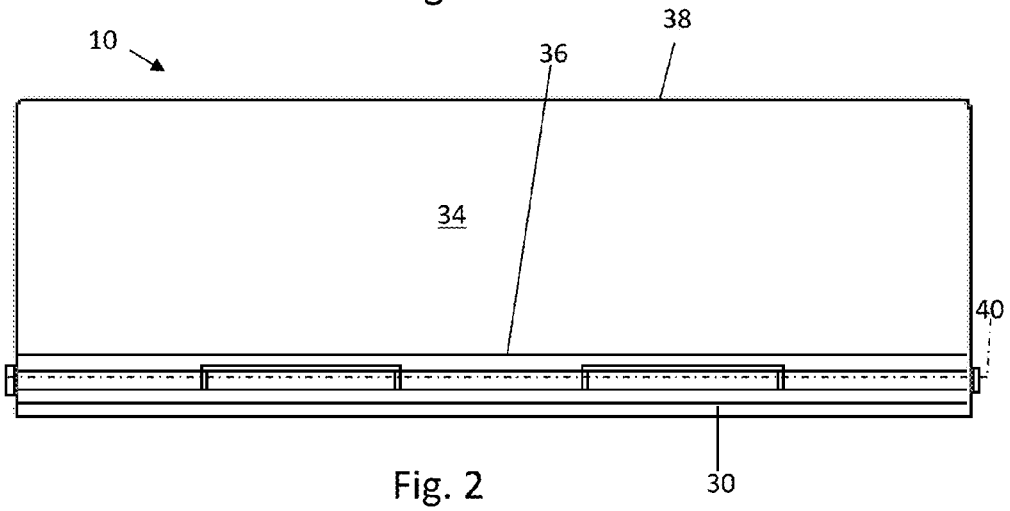
FIG. 2 is a front elevational view of the lock of FIG. 1.
Figure 3:
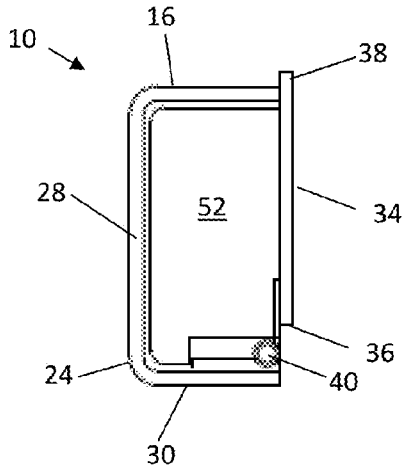
FIG. 3 is a left side elevational view of the lock of FIG. 2.
Figure 4:
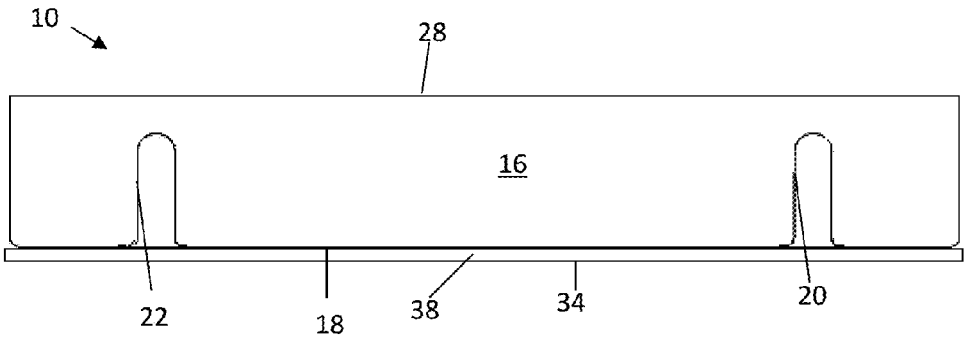
FIG. 4 is a top view of the lock of FIG. 2.
Figure 5:
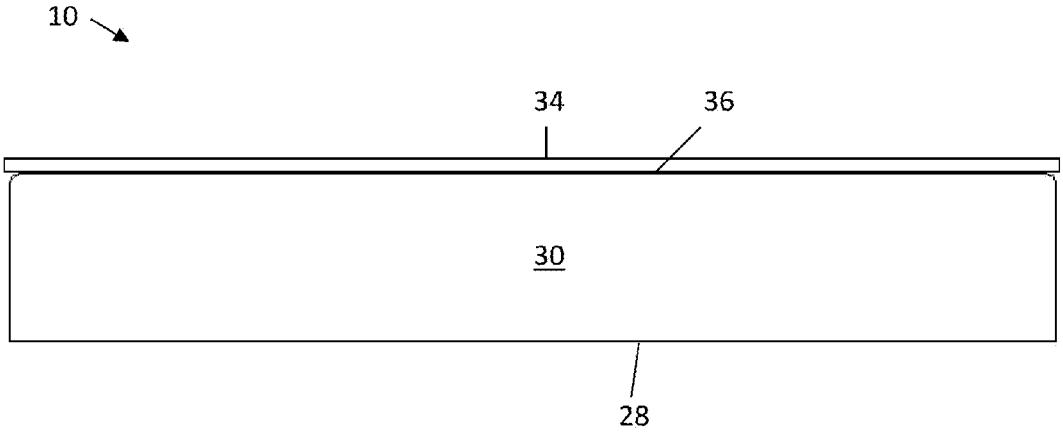
FIG. 5 is a bottom view of the lock of FIG. 2.

To maintain the pivoting member 34 in the second position, a locking mechanism 42 may be provided to operatively secure the pivoting member to the chain engagement portion. For instance, in the arrangement of the lock 10 shown in the drawing figures, an interior compartment 44 is provided between slots of the chain engagement portion 16 within the channel. A locking mechanism (for instance, operated by key, combination (pad lock or other), or electro-magnetically through a sensor) may be disposed in the interior compartment 44. By forming the chain lock with a generally U-shaped configuration, the channel 32 defined by the U-shape may provide the interior compartment 44 that serves as a location to mount the electronics and magnet actuating mechanism associated with the locking mechanism 42. As best shown in FIGS. 1 and 6, the support member 28 may be provided with a conduit hole 46 to pass wires for powering and controlling the electro-magnetics of the locking mechanism 42. The locking mechanism 42 may also have components provided on the pivoting member 34, and/or the chain engagement portion 16 and/or interior compartment 44. For instance, the locking mechanism 42 may include a locking cylinder and key access provided on the pivoting member 34, and a locking engagement portion that cooperates with the cylinder may be arranged on the chain engagement portion 16. In the alternative, the arrangement of the locking cylinder and locking engagement portion may be reversed. A tab extending from the chain engagement portion and a tab extending from the pivoting member may provide a location for the locking mechanism. A hole, either extending through the chain engagement portion or a tab extending from the chain engagement portion, and a hole, either extending through the pivoting member or a tab extending from the pivoting member, may be used to allow use of a pad lock.

A user may operate the locking mechanism 42 to open the lock 10 to allow pivoting of the pivoting member 34 to the first position to enable the chain 12 to be removed from the slot 20,22 and used for operating the overhead door. Once the overhead door is moved to the desired position, the chain 12 may be engaged in the slot 20,22 and the pivoting member 34 may be moved to the second position and locked with the locking mechanism 42. In the case of a locking mechanism 42 comprising an electro-magnetically activated lock, if the pivoting member 34 is made from a magnetically permeable material, such as steel, the pivoting member may be directly engaged by a magnetic actuating mechanism of the locking mechanism 42 installed on the chain engagement portion 16 and/or the interior compartment 44. In the case of a locking mechanism comprising an electro-magnetically activated locking mechanism 42, a sensor 48 may be used to control the locking mechanism 42. The sensor 48 may be actuated by a key, a badge, RFID (i.e., a card reader) or other similar mechanism or bio-metric identification. The sensor 48 may be interfaced with a system 50 (for instance, a security system) to automatically track access to the chain lock 10 and operation of the overhead door 14.

As shown in the drawings, the chain lock inner compartment 44 may be defined by two support walls 52 extending from the chain engagement portion 16 to the mounting portion 30 of the base 24. The walls 52 provide additional structural integrity for the lock 10, for instance, preventing the chain engagement portion 16 from excessively deflecting if the chain 12 is placed under load. Additionally, the walls 52 provide security to prevent attempted manipulation and alteration of the locking mechanism 42. Additionally, the walls 52 prevent attempted intentional bypassing of the lock 10 by preventing manipulating of the chain 12 in the slot 20,22 link by link to advance the chain.

In view of the foregoing, it will be seen that the several advantages are achieved and attained. The embodiments were chosen and described in order to best explain the principles of a practical application to thereby enable others skilled in the art to best utilize the various embodiments and with various modifications as are suited to the particular use contemplated. As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A chain lock comprising a base with a first side wall extending perpendicularly from the base and a second side wall extending perpendicularly from the base, the second side wall being spaced from the first side wall, the first side wall having a slot, the slot being configured to allow a link of a chain to pass therethrough with an adjacent link of the chain engaging the first side wall, the second side wall having a pivoting member pivotally connected thereto, the pivoting member being movable between an open position in which the pivoting member is spaced from the first side wall and a closed position in which the pivoting member extends across the slot in a manner to prevent the chain from entering and being removed from the slot;

wherein the first side wall, the second side wall, the base, and the pivoting member in the closed position define a hollow interior with an opening into the hollow interior at an end of the chain lock.

2. The chain lock of claim 1 wherein the slot has a length and a width, the slot length extends in a direction transverse to the base axis, and the slot width is no greater than a loose press fit relative to the link of the chain to pass through the slot.

3. The chain lock of claim 1 wherein the first and second side walls extend along a length of the base.

4. The chain lock of claim 1 wherein the slot is arranged generally transverse to the length of the first side wall.

5. The chain lock of claim 1 further comprising a second slot on the first side wall.

6. The chain lock of claim 5 wherein the second slot is arranged longitudinally opposite the first slot.

7. The chain lock of claim 1 further comprising a wall extending from the base and between the first and second side walls adjacent to the slot.

8. The chain lock of claim 1 wherein the pivoting member abuts the first side wall in the closed position.

9. A chain lock comprising:

a chain engagement portion having a slot configured to allow a link of a chain to pass therethrough with the chain engagement portion engaging an adjacent link of the chain; and a pivoting member having a proximal end and a distal end, the pivoting member being pivotable about its proximal end such that the distal end is movable between a first position in which the pivoting member distal end is spaced from the slot in a manner to allow a chain to be received in and removed from the slot and a second position in which the pivoting member distal end extends across the slot to prevent the chain from entering and being removed from the slot, the pivoting member having a pivot axis spaced from and parallel to the chain engagement portion;

wherein the chain engagement portion has top and bottom surfaces, and the bottom surface defines at least in part a hollow interior of the chain lock with an opening into the hollow interior of the chain lock at an end of the chain lock.

10. The chain lock of claim 9 wherein the slot has a length and a width, the slot length extends in a direction transverse to the pivoting member pivoting axis, and the slot width is no greater than a loose press fit relative to the link of the chain to pass through the slot.

11. The chain lock of claim 9 wherein the slot extends through an edge of the chain engagement portion.

12. The chain lock of claim 9 wherein the pivoting member distal end abuts the edge of the chain engagement portion at the slot in the second position.

13. The chain lock of claim 9 wherein the pivoting member is generally perpendicular to the chain engagement portion in the second position.

14. The chain lock of claim 9 wherein the edge is generally parallel to the pivot axis.

15. The chain lock of claim 9 wherein the chain engagement portion has a base extending therefrom.

16. The chain lock of claim 15 wherein the pivoting member is pivotally connected to the base.

17. The chain lock of claim 9 further comprising a locking mechanism to secure the pivoting member in the second position.

18. The chain lock of claim 17 wherein the locking mechanism operatively releasably connects the distal end of the pivoting member to the chain engagement portion.

19. The chain lock of claim 18 wherein the locking mechanism comprises an electro-magnetic locking mechanism.

20. The chain lock of claim 19 wherein the electro-magnetic locking mechanism is operable via a sensor.

21. The chain lock of claim 20 wherein the electro-magnetic locking mechanism interfaces with a system that automatically tracks access to the chain lock.

* * * * *